United States Patent [19]

Uemura et al.

[11] Patent Number: 4,534,950

[45] Date of Patent: Aug. 13, 1985

[54] PROCESS FOR PRODUCING CARBON FIBERS

[75] Inventors: Seiichi Uemura, Tokyo; Takao Hirose, Kamakura; Yoshio Sohda, Kawasaki, all of Japan

[73] Assignee: Nippon Oil Co., Ltd., Tokyo, Japan

[21] Appl. No.: 520,157

[22] Filed: Aug. 4, 1983

[30] Foreign Application Priority Data

Aug. 13, 1982 [JP] Japan ..... 57-139796

[51] Int. Cl.[3] ..... D01F 9/12

[52] U.S. Cl. ..... 423/447.4; 423/447.2; 423/447.6

[58] Field of Search ..... 423/447.4; 264/29.2

[56] References Cited

U.S. PATENT DOCUMENTS 3,427,120 2/1969 Shindo et al. ..... 423/447.6
3,556,729 1/1971 Holsten et al. ..... 423/447.4
3,595,946 7/1971 Joo et al. ..... 423/447.6
3,702,054 11/1972 Araki et al. ..... 423/447.6 X
3,886,263 5/1975 Shindo et al. ..... 423/447.4
3,954,947 5/1976 Didchenko et al. ..... 423/447.4

FOREIGN PATENT DOCUMENTS 51-12740 4/1976 Japan .

*Primary Examiner*—Edward J. Meros
*Attorney, Agent, or Firm*—Buchnam and Archer

[57] ABSTRACT

A process for producing carbon fibers, comprising melt spinning a carbonaceous pitch to obtain pitch fibers, contacting the thus obtained pitch fibers with hydrobromic acid, making the thus contacted fibers infusible in an oxidizing atmosphere and then carbonizing and, if desirable, graphitizing the thus treated pitch fibers to obtain the carbon fibers.

8 Claims, No Drawings

PROCESS FOR PRODUCING CARBON FIBERS

This invention relates to a process for the production of carbon fibers from pitch.

The process for producing carbon fibers using pitch as the starting material is advantageous in the inexpensiveness of pitch and the high yield of carbon obtained by carbonization as compared with that using polyacrylonitrile as the starting material and, further, the former process will be more distinctly advantageous in cost over the latter one if it enables the treating times for the heat treating steps thereof such as infusiblization, carbonization or graphitization after spinning of pitch, to be shortened.

Many studies have heretofore been made in an attempt to obtain catalysts or accelerators which will shorten the time for infusiblization, with the result that metal salts, ammonium salts, inorganic acids, halogens, nitrogen oxides and the like have been proposed. However, the compounds so proposed are not satisfactory yet from the view-point of their infusibility accelerating effect and the properties of the resulting final carbon fibers. For example, in cases where pitch fibers are contacted with an inorganic acid such as hydrochloric acid, sulfuric acid or nitric acid and then made infusible, some of the acids will exhibit infusibility accelerating effects and most of them are disadvantageous in that they will degrade the resulting final carbon fibers in properties.

The present inventors made intensive studies and, as a result of their studies, they found that carbon fibers having excellent properties may be obtained from pitch fibers with the use of a remarkably shortened time for making the pitch fibers infusible, by contacting the pitch fibers with hydrobromic acid prior to making the pitch fibers infusible in an oxidizing atmosphere.

More particularly, the process of this invention comprises melt spinning a carbonaceous pitch to obtain pitch fibers, contacting the thus obtained pitch fibers with hydrobromic acid, making the thus contacted fibers infusible in an oxidizing atmosphere and then carbonizing and, if necessary, graphitizing the thus treated pitch fibers to obtain desired carbon fibers.

This invention will be explained below in more detail.

The carbonaceous pitches used in this invention include various pitches, for example, coal-derived pitches such as coal tar pitch and SRC; petroleum-derived pitches such as ethylene tar pitch and decanted oil pitch; and synthetic pitches with the petroleum-derived ones being particularly preferred.

The carbonaceous pitches used in this invention further include various pitches prepared by modifying the above pitches, the modified pitches being illustrated by pitches treated with a hydrogen donor such as tetralin, pitches hydrogenated in a hydrogen atmosphere at a pressure of 20–350 $Kg/cm^2$, pitches reformed by heat treatment, pitches reformed by solvent extraction and pitches reformed by combined use of aforesaid means.

As is seen from the above, the term "carbonaceous pitch" used in this invention is intended to mean any precursor pitches which may produce pitch fibers.

The carbonaceous pitches used in this invention may be optically isotropic or anisotropic pitches.

In a case where an optically isotropic pitch is used in this invention, it is preferable that said pitch have a reflectivity in the range of 9.0–11.0%. The reflectivity is determined by embedding a test pitch in a resin such as an acryl resin, grinding the pitch-embedded resin and then measuring the pitch surface reflectivity by an apparatus for measuring reflectivity. In the measurement, the wavelength of monochromatic light used was 547 nm, the inner diameter of visual field for the measurement was 8 micron and the points measured were 30 points optionally selected from the optically isotropic portion of a material to be measured. The arithmetic average of the values obtained by measurement at said 30 points was deemed to be the reflectivity of the optically isotropic portion of the material so measured.

The optically anisotropic pitches used in this invention are ones which contain optically anisotropic phase (called "mesophase") obtained by heat treating a starting pitch at a temperature of usually 340°–450° C. under atmospheric or reduced pressure in an inert gas such as nitrogen with pitches containing 5–100% of mesophase being preferred.

The carbonaceous pitches used in this invention preferably have a softening point of 240°–400° C., more preferably 260°–300° C. The pitch fibers may be produced by melt spinning said carbonaceous pitch by a known process. For example, the carbonaceous pitch is melted at a temperature higher than its softening point by 30°–80° C. and the thus melted pitch is then extruded through nozzles of 0.1–0.5 mm in diameter while winding the resulting pitch fibers at a speed of 100–2000 m/min. on a take-up bobbin.

It is essential in this invention that the pitch fibers be contacted with hydrobromic acid and then made infusible in an oxidizing atmosphere.

The contact of the pitch fibers with hydrobromic acid is carried out at 0°–200° C., preferably 10°–100° C., for a contact time of 0.1 second to 10 minutes, preferably 1 second to 5 minutes. The concentration of hydrobromic acid used is not particularly limited, however, it is usually 0.1–100%, preferably 1–100%. In addition, the methods for effecting the contact are not limited, but they include application, impregnation and spraying. Further, if necessary, the pitch fibers may be washed after the contact thereof with hydrobromic acid.

The pitch fibers so contacted with hydrobromic acid are then made infusible in an oxidizing atmosphere at usually not higher than 400° C., preferably 150°–380° C., more preferably 200°–350° C. The use of lower treating temperatures will result in lengthening the treating time, while the use of higher treating temperatures will result in causing undesirable fusion of the pitch fibers and loss thereof. The oxidizing gases used herein usually include oxygen, ozone, air, nitrogen oxides, halogens and sulfur oxides. They are used alone or in combination.

The pitch fibers so made infusible are then carbonized or graphitized in an inert gas atmosphere to obtain carbon fibers. The carbonization is effected at usually 800°–2000° C. The time needed for the carbonization is generally in the range of 0.1 minute to 10 hours. Further, the graphitization is carried out at 2000°–3500° C. for usually one second to one hour. In addition, if necessary, some load or tension may be applied to the fibers to be treated, at the time of carbonization or graphitization in order to prevent the shrinkage, deformation and the like of the fibers.

This invention will be better understood by the following non-limitative examples and comparative examples.

EXAMPLE 1

A petroleum-derived precursor pitch having a 80% content of mesophase and a softening point of 280° C. was melt spun to obtain pitch fibers having an average diameter of 17 μm. The thus obtained pitch fibers were contacted with 100% hydrobromic acid for 2 minutes, heated at a temperature-raising rate of 50° C./min. to 340° C. in oxygen to be made infusible and then carbonized in an inert gas atmosphere at 1000° C. to obtain carbon fibers. The carbon fibers so obtained were graphitized at 2500° C. to obtain graphite fibers having an average diameter of 10 μm, a tensile modulus of 60 ton/mm$^2$ and a tensile strength of 250 Kg/mm$^2$.

EXAMPLE 2

A petroleum-derived precursor pitch having a 65% content of mesophase and a softening point of 252° C. was melt spun to obtain pitch fibers having an average diameter of 11 μm. The thus obtained pitch fibers were contacted with 100% hydrobromic acid for 5 minutes, heated at a temperature-raising rate of 80° C./min. to 300° C. in oxygen and then subjected to carbonizing treatment at 1000° C. to obtain carbon fibers. The carbon fibers so obtained were graphitized at 2500° C. to obtain graphite fibers having an average diameter of 9 μm, a tensile modulus of 70 ton/mm$^2$ and a tensile strength of 310 Kg/mm$^2$.

EXAMPLE 3

There was obtained a heavy fraction oil (A) boiling at not lower than 200° C. produced as a by-product at the time of steam cracking of naphtha at 830° C. The oil (A) was heat treated at 400° C. and 15 Kg/cm$^2$.G for 3 hours to obtain a heat treated oil (B). The thus obtained oil (B) was distilled at 250° C./1.0 mmHg to obtain a fraction (C) boiling at 160°–400° C. The fraction (C) was contacted with hydrogen at 330° C., 35 Kg/cm$^2$.G and a LHSV of 1.5 (hr$^{-1}$) in the presence of Ni-Mo catalyst (NM-502) to effect partial nuclear hydrogenation thereby obtaining a hydrogenated oil (D). The degree of nuclear hydrogenation was 31%.

Fifty (50) parts by volume of said heavy fraction oil (A) were mixed with 50 parts by volume of the hydrogenated oil (D) to form a mixture which was heat treated at 430° C. and 20 Kg/cm$^2$.G for 3 hours to obtain a heat treated oil. The thus obtained heat treated oil was distilled at 250° C./1.0 mmHg to distil off the light fraction thereby obtaining a starting pitch having a softening point of 100° C.

The starting pitch was treated at a temperature of 345° C. for 15 minutes under a reduced pressure of 1 mmHg by the use of a film evaporator to obtain a petroleum-derived precursor pitch having a reflectivity of 10.3% and optical isotropy. The thus obtained precursor pitch was measured for reflectivity by the use of a reflectivity measuring apparatus produced by Leitz Company.

The thus obtained petroleum-derived precursor pitch was melt spun to obtain pitch fibers having an average of diameter of 12 μm. The thus obtained pitch fibers were contacted with 100% hydrobromic acid for 5 minutes, heated at a rate of 50° C./min. to 340° C. in oxygen to be made infusible and then subjected to carbonizing treatment at 1000° C. thereby obtaining carbon fibers. The thus obtained carbon fibers had a tensile strength of 98 Kg/mm$^2$ and a tensile modulus of 10 ton/mm$^2$. The carbon fibers so obtained were graphitized at 2500° C. to obtain graphite fibers having a tensile modulus of 60 ton/mm$^2$ and a tensile strength of 250 Kg/mm$^2$.

EXAMPLE 4

One hundred and fifty (150) ml of the heavy fraction oil (A) as obtained in Example 3 were charged into a 300-ml autoclave provided with an agitator, heated at a rate of 3° C./min. to 430° C. and maintained at this temperature for 3 hours, after which the heating was stopped and the temperature lowered to room temperature to obtain a liquid product. The thus obtained liquid product was distilled at 250° C./1 mmHg to distil off the light fraction thereby obtaining a starting pitch.

The pitch so obtained was treated at 345° C./1 mmHg for 15 minutes by the use of a film evaporator to obtain a petroleum-derived isotropic precursor pitch having a reflectivity of 9.8%. The thus obtained precursor pitch was melt spun to obtain pitch fibers having an average diameter of 11 μm. The thus obtained pitch fibers were contacted with 100% hydrobromic acid for 5 minutes, heated at a temperature-raising rate of 80° C./min. to 300° C. in oxygen to be made infusible and then subjected to carbonizing treatment at 1000° C. thereby to obtain carbon fibers having a tensile strength of 102 Kg/mm$^2$ and a tensile modulus of 11 ton/mm$^2$. The carbon fibers so obtained were graphitized at 2500° C. in an inert gas atmosphere to obtain graphite fibers having a tensile strength of 270 Kg/mm$^2$ and a tensile modulus of 50 ton/mm$^2$.

COMPARATIVE EXAMPLE 1

The pitch fibers as obtained in Example 1 were heated at a temperature-raising rate of 50° C./min. to 340° C. in oxygen with the result that the fibers were fused together during the infusiblization whereby it was impossible to obtain the fibers individually separate form.

COMPARATIVE EXAMPLE 2

The pitch fibers as obtained in Example 1 were contacted with hydrochloric acid or sulfuric acid for 2 minutes and heated at a temperature-raising rate of 50° C./min. to 340° C. in oxygen with the result that the fibers were degraded and damaged during infusiblization whereby it was impossible to obtain excellent graphitized fibers.

COMPARATIVE EXAMPLE 3

The pitch fibers as obtained in Example 1 were contacted with nitric acid for 5 minutes, after which they were made infusible, carbonized and graphitized in the same manner as in Example 1 with the result that the graphite fibers so obtained had only a tensile modulus of 30 ton/mm$^2$ and a tensile strength of 120 Kg/mm$^2$.

What is claimed is:

1. A process for producing carbon fibers, which consist of melt spinning a carbonaceous pitch to obtain pitch fibers, contacting the thus obtained pitch fibers with hydrobromic acid, making the thus contacted fibers infusible in an oxidizing atmosphere and then carbonizing or graphitizing the thus treated pitch fibers to obtain the carbon fibers.

2. A process according to claim 1, wherein the contacting with hydrobromic acid is effected with 0.1–100% hydrobromic acid at 0°–200° C. for 0.1 second to 10 minutes.

3. A process according to claim 1, wherein the carbonaceous pitch has a softening point of 240°–400° C.

4. The process according to claim 1 wherein the contacting of the pitch fibers with hydrobromic acid is carried out by impregnation.

5. The process according to claim 1 wherein the contacting of the pitch fibers with hydrobromic acid is carried out by spraying.

6. The process according to claim 1 wherein said pitch fibers are made infusible by treatment with an oxidizing agent at a temperature of 150°–380° C.

7. The process according to claim 1 wherein the carbonaceous pitch is coal-derived or a petroleum-derived pitch.

8. The process according to claim 1 wherein the carbonaceous pitch is an anisotropic or an optically isotropic pitch of reflectivity in the range of 9–11%.

* * * * *